US006008832A

United States Patent [19]

Sato

[11] Patent Number: 6,008,832

[45] Date of Patent: Dec. 28, 1999

[54] THERMAL PRINTER

[75] Inventor: Junichi Sato, Ohmiya, Japan

[73] Assignee: Shinsei Industries Co., Ltd., Tokyo, Japan

[21] Appl. No.: 09/000,414

[22] PCT Filed: May 26, 1997

[86] PCT No.: PCT/JP97/01765

§ 371 Date: Feb. 3, 1998

§ 102(e) Date: Feb. 3, 1998

[87] PCT Pub. No.: WO97/46392

PCT Pub. Date: Dec. 11, 1997

[30] Foreign Application Priority Data

Jun. 3, 1996 [JP] Japan ..... 8-178400

[51] Int. Cl.[6] ..... B41J 25/304

[52] U.S. Cl. ..... 347/197

[58] Field of Search ..... 347/197, 222; 400/120.16, 120.17

[56] References Cited

U.S. PATENT DOCUMENTS 4,820,064 4/1989 Sato et al. ..... 400/120.16

5,049,228 9/1991 Sato ..... 156/384

5,559,545 9/1996 Fuwa ..... 347/171

5,694,159 12/1997 Kajiya et al. ..... 347/197

5,697,714 12/1997 Onuki et al. ..... 400/120.16

5,725,317 3/1998 Gonmori et al. ..... 400/58

*Primary Examiner*—N. Le

*Assistant Examiner*—Anh T.N. Vo

*Attorney, Agent, or Firm*—Fish & Richardson P.C.

[57] ABSTRACT

A thermal head (255) is placed on a head block plate (230) cantilevered to a base portion (103) to come into contact with, or separate from, a platen roller (210), and an operating member (260) manually operated Is rotatably provided for this contact or separation. The operating member (260) is designed so that the thermal head (255) is made to abut against the platen roller (210) on the way to the final stage of operation, a spring (270) for pressing the thermal head against the platen roller is biased, and at the final stage, an end (260*e*) thereof is trapped,into a receiver (190*a*) constructed integral with the base portion to support a part of the side on which the head block plate (230) is not supported. In this way, the stability of operation and durability are assured.

2 Claims, 6 Drawing Sheets

THERMAL PRINTER

TECHNICAL FIELD

This Invention relates to a thermal printer in which printing is made on recording paper (namely, labels temporarily pasted in succession on elongated mounting paper) which is wound into a roll, by a printing section equipped with a platen roller and a thermal head.

BACKGROUND ART

Some of thermal printers of this type are designed so that, in order to facilitate loading of a recording paper roll on the printing section, for example, the thermal head is cantilevered in a printer body and thereby the recording paper can be loaded from the side of the free end of the thermal head.

Such thermal printers, however, have the drawback of being inferior in stability of operation and durability because the thermal head is cantilevered.

It is, therefore, an object of the present invention to provide a thermal printer which is free of such a drawback as in a conventional thermal printer and is excellent in stability of operation and durability.

BEST MODE FOR CARRYING OUT THE INVENTION

Referring to the attached drawings, the present invention will be explained in detail below.

Figure 1:
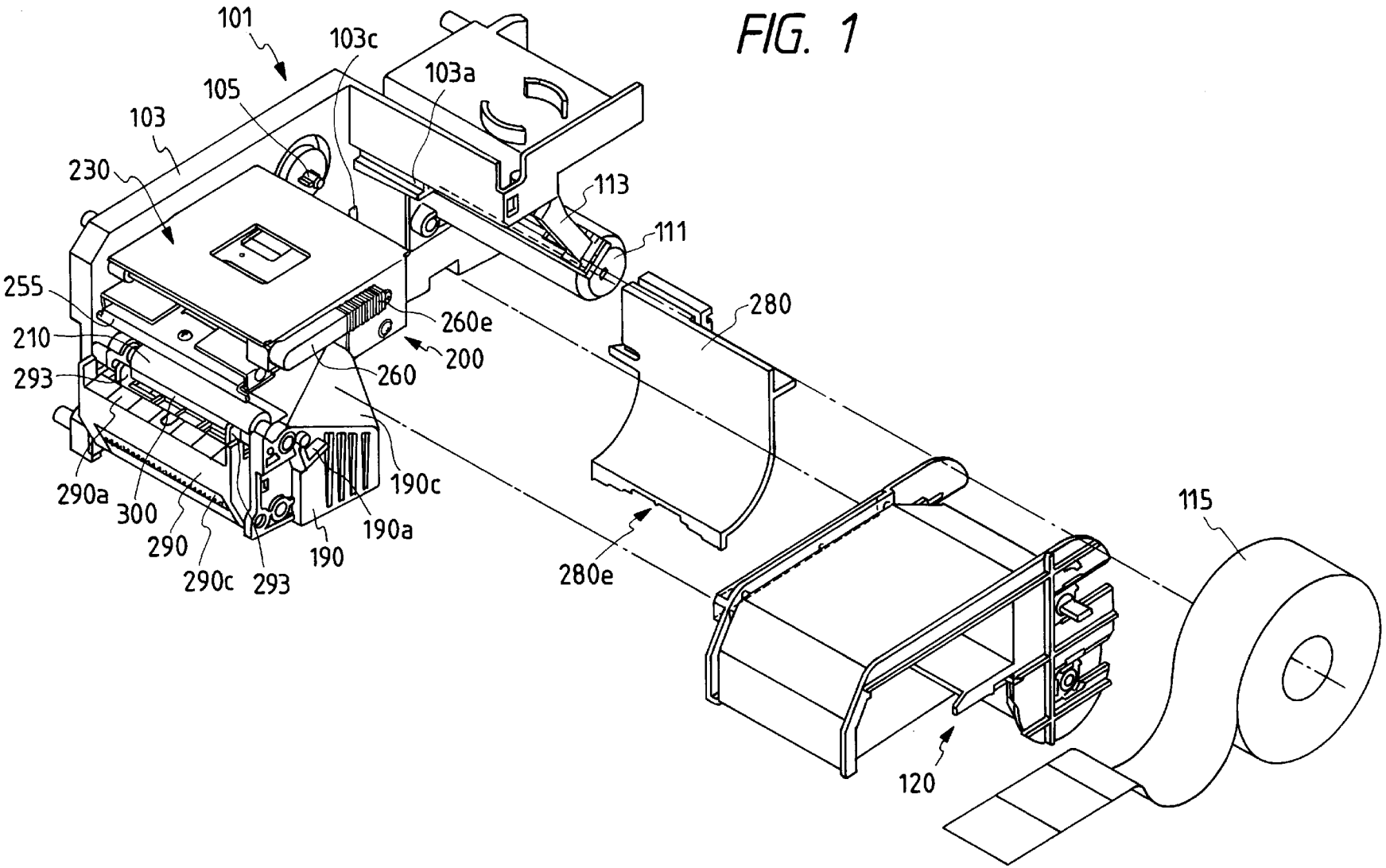
FIG. 1 is a perspective exploded view showing a recording-paper loading section, a recording paper traveling section, an ink ribbon cassette, and a printing section which is not set, in the thermal printer according to the present invention.
Figure 2:
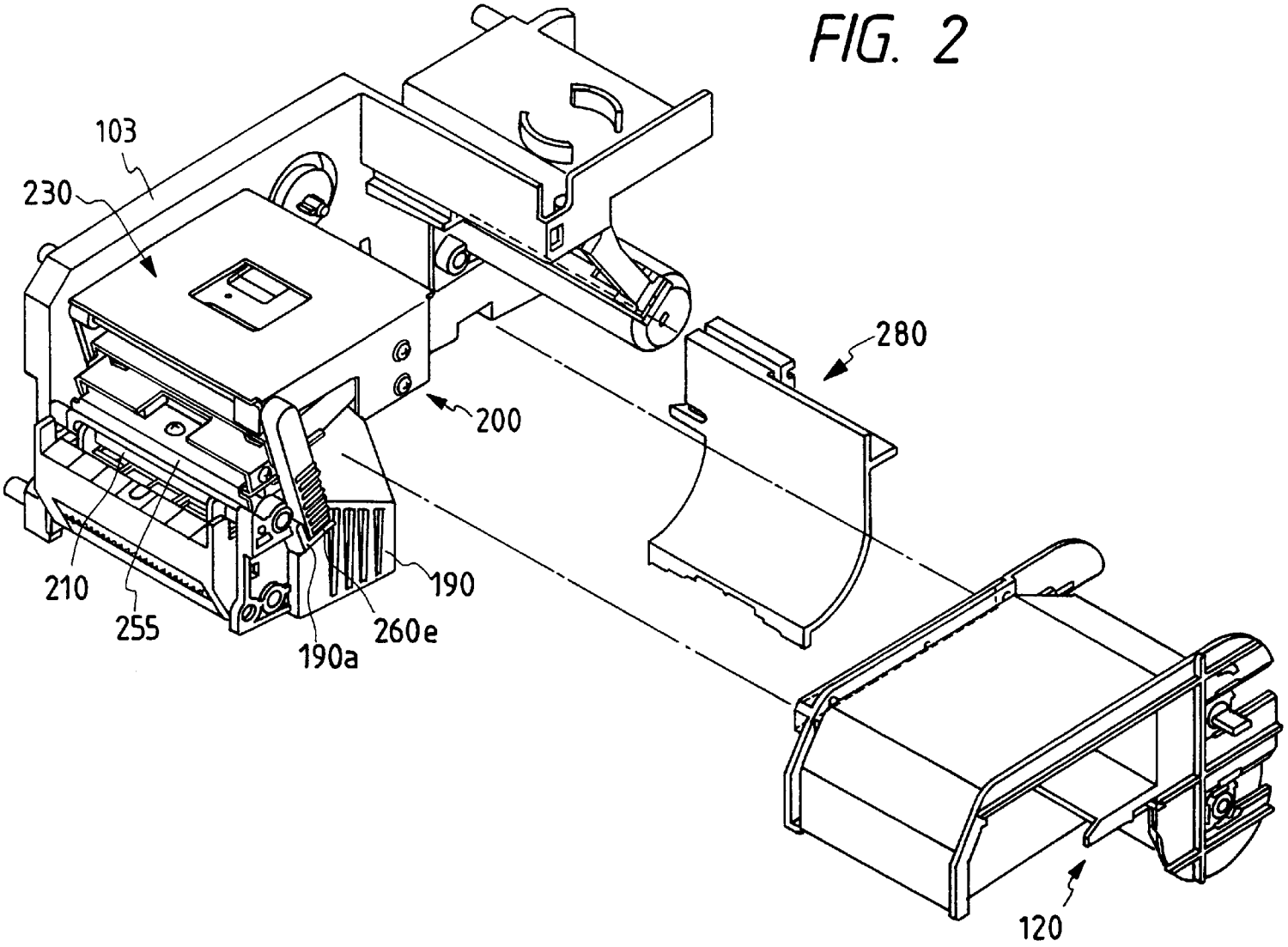
FIG. 2 is a perspective exploded view, similar to FIG. 1, showing the printing section which is set.

In FIGS. 1 and 2, reference numeral 101 denotes a molded printer base rigidly mounted to a printer body (a bottom plate) not shown, having a wall-like base portion 103. A motor protection 190 whose upper face functions as a traveling path of recording paper (a path for labels) is fixed to the body and the base portion 103.

Reference numeral 111 denotes a roll feed shaft cantilevered In a fixed state, suspending a recording paper roll. A pair of width holders free to slide in opposite directions from the center of the shaft along the longitudinal direction thereof are arranged In the periphery of the shaft. One of width holders 113 located on the side of the free end of the shaft can be raised (as in FIG. 1) or folded so that a label roll 115 is mounted on the feed shaft in a folded state and then when the holder 113 is raised and the label roll 115 is pushed inwardly, together with the holder, the other holder remaining raised on the side of the fixed end of the shaft is moved toward the free end by a rack mechanism inside the shaft. Subsequently, the label roll 115, when sandwiched between both holders, is suspended at an intermediate position in the longitudinal direction of the shaft.

Here, the label roll 115 used as the recording paper is such that labels of constant width are temporarily pasted in turn on elongated, continuous mounting paper and are wound into a roll.

Figure 3:
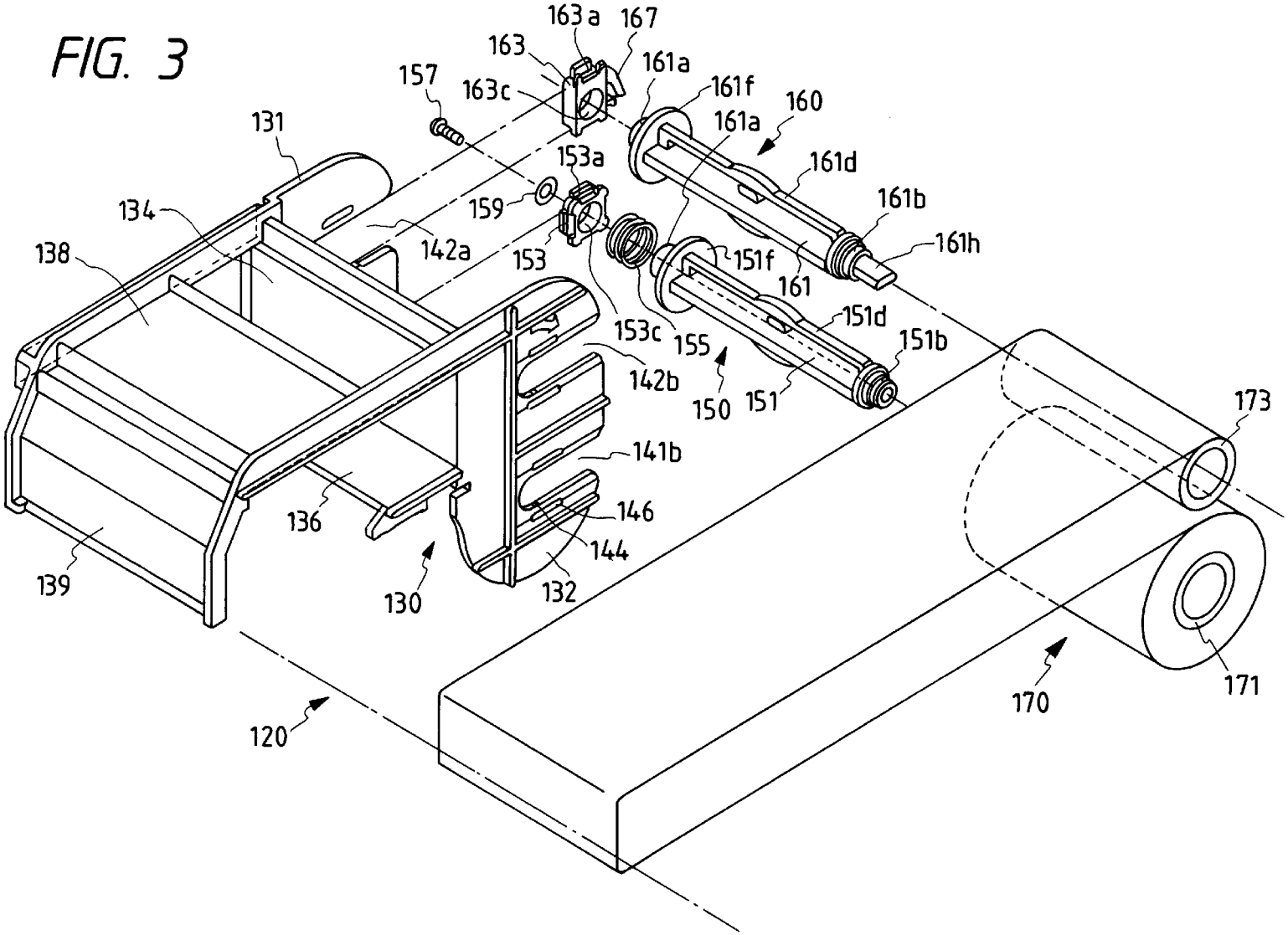
FIG. 3 is a perspective exploded view showing the Ink ribbon cassette.
Figure 5:
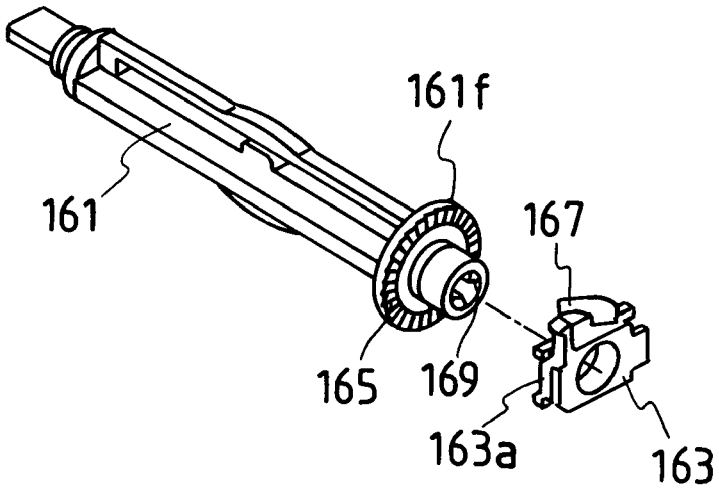
FIG. 5 is a perspective view showing a winding shaft, viewed from the opposite side of FIG. 3, of the ink ribbon cassette.

Referring to FIGS. 3 and 5 as well, reference numeral 120 represents an ink ribbon cassette, which includes a cassette base 130, a feed shafting 150, a winding shafting 160, and an ink ribbon 170, and which has no armored member so that the ink ribbon 170 is exposed directly.

The cassette base 130, for example, is molded, and comprises left- and right-hand side plates 131 and 132; a connecting plate 134 connecting the side plates 131 and 132; a ribbon feed guide 136 having a width practically corresponding to a direction between the side plates 131 and 132 and extending perpendicularly on the opposite side of the side plates 131 and 132, from the lower portion of the connecting plate 134; a ribbon winding guide 138 extending in the same direction as the feed guide 136 froth the upper portion of the connecting plate 134, ahead of the feed guide 136 (on the downstream side in a traveling direction of the recording paper which will be described later); and a ribbon removing guide 139 extending to a position on an extension line from the feed guide 136, nearly parallel with the connecting plate 134, after connecting with the winding guide 138 and inclining forward.

Flanges for guiding and protecting the ink ribbon 170 are configured at both ends in a lateral direction of the feed guide 136, the winding guide 138, and the removing guide 139.

An opening provided between the feed guide 136 and the removing guide 139 and a space enclosed with the connecting plate 134, the feed guide 136, the winding guide 138, and the removing guide 139 allow a head unit 220, described later, to be enveloped therein, and serve to support the ink ribbon cassette 120 by the head unit 220.

Figure 8:
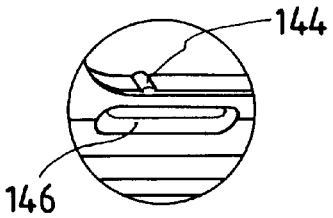
FIG. 8 is an enlarged view showing a removing mechanism for each shaft in the ink ribbon cassette.

The side plates 131 and 132 of the cassette base 130 are provided with two pair of slot-shaped bearings 141*a* (not shown) and 141*b*; and 142*a* and 142*b* for arranging the feed shafting 150 and the winding shafting 160 in a direction perpendicular to the traveling direction of the recording paper. In the upper and lower parts of each of the bearings, resilience working portions capable of engaging with the shafting are provided. Each of the resilience working portions, as shown in FIG. 8, is configured with a projection 144 lying along the thickness, for example, of the side plate 131 and a slit 146 bored to reduce a thickness on the underside of the projection 144 and to provide resilience.

The feed shafting 150 is chiefly composed of a feed shaft 151, a bearing ring 153, and a compression spring 155. The feed shaft 151 includes columns 151*a* and 151*b* provided at its both ends, resilient plates 151*d* extending on opposite sides along a longitudinal direction of a shaft drum, and a disc 151*f* interposed between the column 151*a* and the resilient plates 151*d*. The bearing ring 153 has upper and lower fitting portions 153*a* riding on the bearing edges of the side plate 131 to fit the bearing 141*a* closely and serve as a detent, and a center opening 153*c* into which the column 151*a* of the feed shaft 151 is loosely fitted. A screw 157 is set to the end face of the column 151*a* through a washer 159 from the outside of the bearing ring 153 so that the compression spring 155 is sandwiched between the disc 151*f* and the ring 153 and thereby the feed shaft 151 is subjected to resistance when rotating.

The winding shafting 160 is made up of a winding shaft 161 and a bearing ring 163. The winding shaft 161 includes a cylinder 161*a*, a column 161*b*, resilient plates 161*d* extending on opposite sides of a shaft drum, a disc 161*f* interposed between the cylinder 161*a* and the resilient plates 161*d*, and a knob 161*h* extending outside the column 161*b*. The bearing ring 163 has upper and lower fitting portions 163*a* relative to the bearing 142*a* identical with the bearing 141*a* and a center opening 163*c* into which the cylinder 161*a* is loosely fitted. A well-known anti-reversion mechanism is constructed with a ratchet 165 configured on the face of the disc 161*f* opposite to the ring 163 and a ratchet claw 167 provided on the bearing ring 163, having resilience so as to engage the ratchet 165. The inner wall of the cylinder 161*a* is configured with a plurality of projections 169 for engaging a driving system 105 protruding from the printer body.

Also, in FIG. 5, the bearing ring 163 is turned by 90° to the right so that the contour of the ratchet claw 167 can easily be seen.

For the ink ribbon 170, an unused piece of a ribbon is wound on a feed paper reel 171, and the top of a used piece for printing of the ribbon is held on a winding paper reel 173. The resilient plates 151*d* of the winding shaft 151 are resiliently fitted into the feed paper tube 171, while the resilient plates 16*d* of the winding shaft 161 are also resiliently fitted into the winding paper reel 173. Subsequently, the feed shafting 150 is inserted in the bearings 141*a* and 141*b* in such a way that the bearing ring 153 holds the side plates 131 through the fitting portions 153*a*. The ribbon is passed in the order of the feed guide 136, the removing guide 139, and the winding guide 138, and the winding shafting 160 is inserted in the bearing 142*a* and 142*b* in such a way that the bearing ring 163 holds the side plates 131 through the fitting portions 163*a*. Finally, the knob 161*h* is turned to tighten the ribbon. In this way, the ink ribbon cassette shown in FIG. 1 is obtained.

In the ink ribbon cassette 120, a friction (rotation load) between the bearing ring 153 and the feed shaft 151 is set to a maximum by the compression spring 155, and thus if the knob 16*h* is turned after the ink ribbon 170 is tightened, slippage will occur between each of the resilient plates 161*d* of the winding shaft 161 and the winding paper reel 173. Furthermore, by the anti-reversion mechanism constructed with the ratchet 165 and the ratchet claw 167, the knob 161*h* cannot be turned in the direction in which the slack of the ink ribbon 170 is caused, and hence the tension of the ink ribbon 170 is kept.

The ink ribbon 170 run out front the feed shaft 151 in a couterclockwise direction is wound, through the feed guide 136, the removing guide 139, and the winding guide 138, on the winding shaft 161 in a clockwise direction.

As will be described later, the ink ribbon cassette 120 is supported by a head block plate 230 interposed between the feed guide 136 and the winding guide 138, and since a ribbon winding region secured around the winding shaft 161 is positioned above the feed guide 136, a space in a vertical direction of this region approximates that of a region containing the structure of a head unit 220 which must exist as a matter of course.

A recording paper incorporating region around the roll feed shaft 111, on the one hand, is broadly set so that the most possible labels can be stored, and on the other hand, the ink ribbon is much smaller in thickness than the mounting paper with the labels and is positioned below the feed guide 136 in order to reduce a roundabout route of a label continuum described later. The width of a ribbon incorporating region around the feed shaft 151 which follows a straight traveling path from the feed section of the recording paper to the printing section is set to be narrower than that of the recording paper incorporating region.

Figure 4:
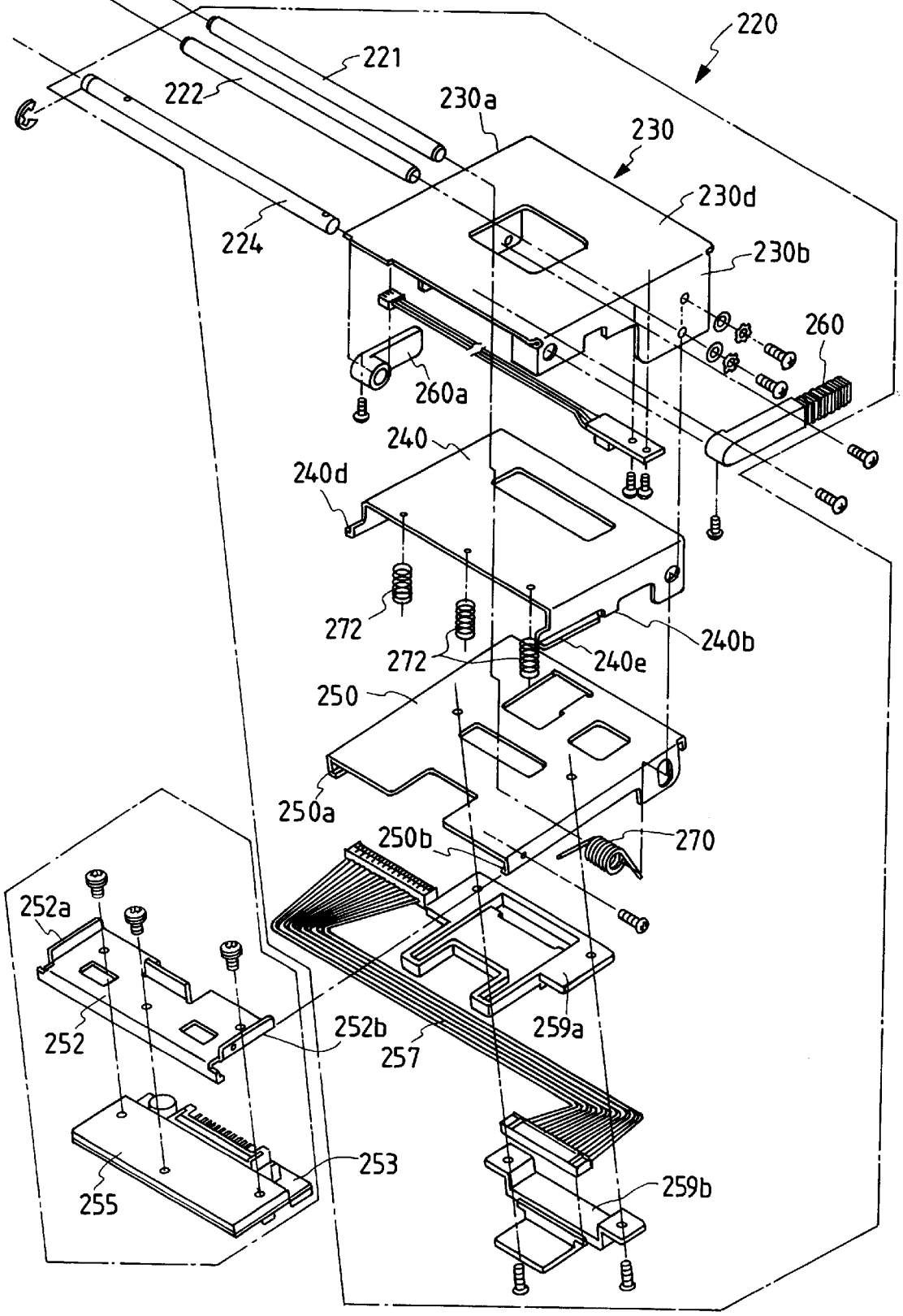
FIG. 4 is a perspective exploded view showing one embodiment of a head block of the printing section.

In FIGS. 1, 2, and 4, reference numeral 200 designates a printing section, which includes a platen roller 210 rotatably located at a fixed position on the top face of the motor protection 190 and a thermal head 255 placed in the head unit 220 explained below. The platen roller 210 is such that a portion, not seen from the figure, located at the left hand end of its shaft is connected to the driving system of a motor. The head unit 220 is constructed with a head block plate 230 composed of side plates 230*a* and 230*b* cantilevered on the base portion 103 by fixed shafts 221 and 222, and of a connection 230*d* connecting the side plates; a head operating plate 240 and a head supporting plate 250 which are rotatably supported by the fixed shaft 221 placed between the side plates 230*a* and 230*b*; an upper head supporting plate 252 and a lower head supporting plate 253; a thermal head (having a segment resistance on the underside) 255 provided with connecting pins; flexible cables 257 connecting an input connector and an output connector; mounting plates 259*a* and 259*b* for securing the connectors to the head supporting plate 250; and an operating arm 260 rotatably supported through the head block plate 230 at one end of a connecting shaft 224 with an auxiliary arm 260*a* fixed at the other end. The thermal head 255 sandwiched between the upper head supporting plate 252 and the lower head supporting plate 253 is removably mounted to the head supporting plate 250 by fitting edge risers 252*a* and 252*b* of the upper plate 252 into bent rails 250*a* and 250*b* of the supporting plate 250. In this way, when the thermal head 255 is pushed in the supporting plate 250, the connecting pins and the output connector are electrically connected, and the thermal head 255 is secured by a screw from the outside of the supporting plate 250.

The head operating plate 240 is provided with a rotational bias such that it approaches the head block plate 230 (namely, in the figure, the thermal head 255 is separated from the platen roller 210 in a clockwise direction) by a spring 270 coiled on the fixed shaft 221 and provided on the underside of the head supporting plate 250.

The head operating plate 240 and the head supporting plate 250 are such that the amount of mutual separation is limited by edge risers 240*a* (not shown) and 240*b* extending from the outside to the inside of the operating plate 240, and compression springs 272 are interposed between both plates, which are basically turned as a unit. However, the head operating plate 240 can be turned counterclockwise even after the thermal head 255 (namely the head supporting plate 250) abuts against the platen roller 210, and functions so that the thermal head 255 is pressed against the roller 210 by the biasing force of the compression spring 272.

The operating arm 260 and the auxiliary arm 260*a* are integrally connected through the connecting shaft 224. When the operating arm 260 is turned clockwise, the end face of the auxiliary arm 260*a* and a projection 260*c* configured inside the operation arm 260 push edge risers 240*d* and 240*e*, respectively, of the head operating plate 240. In this way, the operating plate 240 can be turned counterclockwise against the biasing force of the spring 270. The operating arm 260 continues with the counterclockwise turn of the operating plate 240 in association with the auxiliary arm 260*a* even after the thermal head 255 abuts against the platen roller 210. Eventually, as shown in FIG. 2, an end 260*e* of the arm 260 is trapped into a receiving portion 190*a* configured on a part of the motor protection 190 so that a part of the side on which the head block plate 230 is not supported is raised and supported.

The state of FIG. 2 in which the thermal head 255 is pressed against the platen roller 210 is brought about after the recording paper or the recording paper and the ink ribbon cassette 120 are loaded as a preparatory operation. On the other hand, a restoration to the state of FIG. 1 for the loading of new (other) recording paper or replacement of the ink ribbon cassette 120 is carried out in such a way that when the operating arm 260 is turned counterclockwise from the position of FIG. 2, the action of a clockwise turn by the biasing force of the spring 270 is exerted on the head operating plate 240 from some point.

Figure 6:
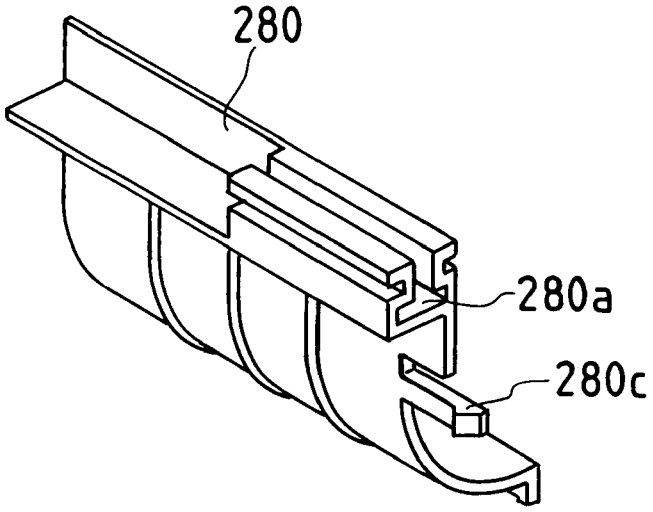
FIG. 6 is a perspective view showing a guide member, viewed from the opposite side of FIG. 1 or 2.

In FIGS. 1, 2, and 6, reference numeral 280 denotes a guide plate of the recording paper which is set to the body when the present printer is of a heat transfer type using the ink ribbon 170 as a minimum, having a groove 280*a* of T-shaped cross section into which a projection 103*a* of T-shaped cross section configured on the base portion 103 is fitted and a locking claw 280*c* with which a hole 103*c* bored through the base portion 103 is engaged.

The guide plate 280 is held by the T-shaped projection 103*a* interposed between the roll feed shaft 111 and the driving shaft 105 to lie between the feed section of the recording paper and the ink ribbon cassette 120. In this way, the guide plate 280 is shaped into a tongue piece form, with a length extending downwardly of the ribbon roll incorporating region (the lower end of the side plate 132) on the feed side, nearly parallel with a plane containing the feed shaft 151 and the winding shaft 161 in the cassette 120. At the lower top of the guide plate 280, a width guide 280*e* for conducting recording paper of different widths along its ends to its width is shaped into a step-like form.

In a label issue port located immediately on the downstream side of the printing section including the platen roller 210 and the thermal head 155, a label receiver 290 provided together with the platen roller 210 and a removing pin 300, having exit width guides 293 is rotatably supported between the underside of a portion extended on the downstream side from the motor protection 190 and the lower left-hand corner of the base portion 103.

The exit width guides 293, like the width holders 113 of the roll feed shaft 111, can be synchronized by a built-in rack mechanism to approach or separate laterally.

The label receiver 290 is configured with a label receiving face 290*a* having some striped projections along a traveling direction of the label continuum and with a discharge port 290*c* for the mounting paper having a saw-toothed cutter on the supporting portion. In the label receiver 290, a setting state shown in the figure and an open state where it is turned counterclockwise from the state of the figure can be brought about. In addition, a removing roller, not shown, is rotatably supported which is pressed against the platen roller 210 on the opposite side of the thermal head 255 (at the position where it does not interfere), inside the receiver, in the setting state.

According to the structure mentioned above, the roll feed shaft 111, the ink ribbon cassette 120, and the head unit 220 are cantilevered with respect. to the printer base 101.

The ink ribbon cassette 120 is pushed inwardly from the side on which the head block plate 230 is not supported, and held in such a manner that the head unit 220 is enclosed in a space provided by the connecting plate 134, the feed guide 136, the winding guide 138, and the removing guide 139, from the state of FIG. 1. The projections 169 of the winding shaft 161 are engaged with the ribbon driving system 105 on the side of the printer base 101, and only a part of the ink ribbon 170 lying between the feed guide 136 and the removing guide 139 is located between the platen roller 210 and the thermal head 255.

The label roll 115 which is the recording paper is put on the roll feed shaft 111 in a state where the width holder 113 is folded, and is suspended at the intermediate position of the feed shaft 111 when the width holder 113 is raised and pushed inwardly.

The top sheet of the label roll 115 is pulled out, takes a roundabout route over the top of the guide plate 280 while being guided by the width guide 280*e* fitting its own width, and is loaded between the thermal head 255 and the platen roller 210 through the ink ribbon 170, from the side on which the head unit 220 is not supported, in such a manner as to creep along the upper face of the motor protection 190 without interfering with the ink ribbon cassette 120.

The loading of the label roll 115 to the printing section is easily carried out because an upper right-hand corner 190*c* of the motor protection 190 is inclined and rounded off.

Furthermore, the top of the label continuum passing through the printing section is such that its both sides is restricted by the adjustment of the exit width guides 293, and the whole of the label continuum is laid in the middle of the traveling path under restrictions by the width holders 113 of the roll feed shaft 111 and the width guide 280*e* of the guide plate 280.

A favorable state of printing is brought about when the operating arm 260 is turned clockwise from the position of FIG. 1 to the position of FIG. 2 and the thermal head 255 is pressed against the platen roller 210 through the ink ribbon 170 and the label continuum. At this time, the end 260*e* of the operating arm 260 is trapped into the receiving portion 190*a* of the motor protection 190 to thereby support a part of the side on which the head block plate 230 is not supported.

In a continuous issue mode, namely in the case where printing is made in a state that labels are temporarily pasted on the mounting paper without being removed, when the top of the label continuum is merely held in the printing section, a printed label travels along the label receiving face 290*a* of the label receiver 290, with printing operation, and is issued together with the mounting paper.

In a removing issue mode, namely in the case where a label, after being printed, is removed from the mounting paper and issued on the label receiving face 290*a*, the top of the label continuum is pulled out, to some extent, from the printing section, and a label traveling through the printing section is removed. Subsequently, the label receiver 290 is opened and closed, and tile mounting paper from which the label has been removed, after Its traveling direction is rapidly changed through the removing pin 300, is held between the platen roller 210 and the removing roller in such a way that the top of the mounting paper protrudes from the discharge port 290*c*.

Figure 7:
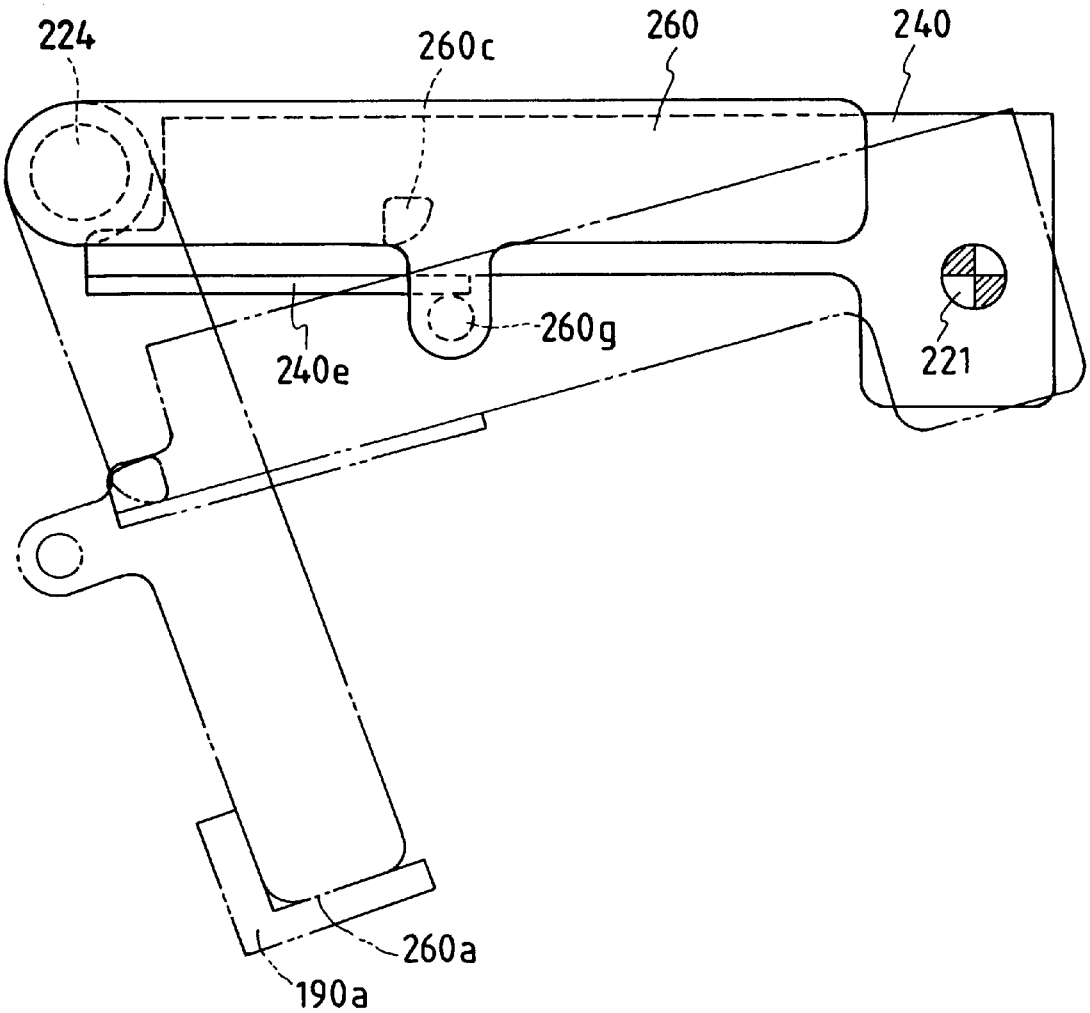
FIG. 7 is a partial side view showing another embodiment of a setting mechanism of the printing section.

The maintenance of, or restoration to, a state of separation between the platen roller 210 and the thermal head 255 in FIG. 2, based on one embodiment of the thermal head block in FIG. 4, is done by the behavior of the spring 270, but can also be accomplished by another embodiment shown in FIG. 7, without using the spring 270.

In addition to the projection 260*c* for pressing down the edge riser 240*e* of the head operating plate 240, the operating arm 160 is configured integral with a pin 260g for pushing the edge riser 240*e* upwardly. The arm 260 is temporarily held by a well-known click device interposed between the arm 260 and the head block plate 230 as in FIG. 2.

The separation or contact between the platen roller 210 and the head operating plate 240 in this embodiment is carried out as in the above embodiment with respect to a change of operation from FIG. 1 to FIG. 2. When the operating arm 260 is turned counterclockwise from the position of FIG. 2, the projection 260*c* retires from the edge riser 240*e* and at the same time, the pin 260*g* approaches and pushes upward the riser 240*e*. Finally, tile operating arm 260 is temporarily held to the head block plate 130, and thus the position of FIG. 1 is attained.

INDUSTRIAL APPLICABILITY

As mentioned above, the thermal printer according to the present invention can be designed to assure stable operation and durability and is extremely useful for practical use.

I claim:

1. A thermal printer comprising:

a body;

a platen roller rotatably placed in said body;

a head block plate including a pair of opposite side plate portions fixed to said body and a connection that connects the side plate portions, said head block plate forming a cantilever structure with one of the side plate portions that is fixed to the body;

a head operating plate rotatably supported between the side plate portions of said head block plate;

a head supporting plate rotatably supported between the side plate portions of said head block plate;

a thermal head supported by said head supporting plate so as to be opposite to said platen roller;

a first spring provided between said head operating plate and said head supporting plate to separate said head operating plate from said head supporting plate;

locking portions configured in one of said head operating plate and said head supporting plate to limit an amount of separation between said head operating plate and said head supporting plate;

a second spring providing said head operating plate with a rotational bias which is directed to separate said thermal head from said platen roller; and an operating member rotatably mounted to said head block plate, wherein a rotational operation of said operating member causes said head operating plate to be displaced from a first position against a resilience of said second spring so that said thermal head moves toward and then abuts against said platen roller, until a resilience of said first spring presses said thermal head against said platen roller, and wherein said operating member is constructed so that, at a final stage of the rotational operation thereof where said thermal head abuts against said platen roller, one portion of said operating member is held in the body to urge said head block plate upwardly at a position that is located on a support-free side of the cantilever structure, whereby said support-free side is supported.

2. A thermal printer comprising:

a body;

a platen roller rotatably placed in said body;

a head block plate including a pair of opposite side plate portions and a connection that connects the side plate portions, said head block plate forming a cantilever structure with one of the side plate portions being fixed to the body;

a head operating plate rotatably supported between the side plate portions of said head block plate;

a head supporting plate rotatably supported between the side plate portions of said head block plate;

a thermal head supported by said head supporting plate so as to be opposite to said platen roller;

a spring provided between said head operating plate and said head supporting plate to separate said head operating plate from said head supporting plate;

locking portions configured in one of said head operating plate and said head supporting plate to limit an amount of separation between said head operating plate and said head supporting plate; and an operating member rotatable mounted to said head block plate, said operating member having a static condition where it is temporarily locked to said head block plate with said head operating plate being held at a position where said thermal head is kept separated from said platen roller;

wherein an application of an operating force to unlock and rotate said operating member in said static condition causes said head operating plate to rotate so that said thermal head moves toward and then abuts against the platen roller, until a resilience of said spring presses said thermal head against said platen roller, and wherein said operating member is constructed so that, at a final stage of rotational operation thereof where said thermal head abuts against said platen roller, one portion of said operating member is held in the body to urge said head block plate upwardly at a position that is located on a support-free side of the cantilever structure, whereby said support-free side is supported.

* * * * *